United States Patent [19]

Pott

[11] 4,105,197

[45] Aug. 8, 1978

[54] APPARATUS FOR FOLDING COLLAPSIBLE BOX BLANKS

[76] Inventor: Heinz-Hermann Pott, Pottwiesenstr. 10, D-4904 Enger, Fed. Rep. of Germany

[21] Appl. No.: 721,747

[22] Filed: Sep. 9, 1976

[30] Foreign Application Priority Data

Sep. 12, 1975 [DE] Fed. Rep. of Germany ..... 2540649

[51] Int. Cl.[2] ..... B65H 45/14

[52] U.S. Cl. ..... 270/68 R

[58] Field of Search ..... 270/68 R, 68 A, 67, 270/80; 93/84 R, 49 R, 53

[56] References Cited

U.S. PATENT DOCUMENTS

| | | | |
|---|---|---|---|
| 2,857,827 | 10/1958 | Labombarde | 93/49 R |
| 3,388,641 | 6/1968 | Gobel | 93/49 R |
| 3,572,688 | 3/1971 | Mazzolla | 270/68 R |

*Primary Examiner*—Edgar S. Burr

*Assistant Examiner*—A. Heinz

*Attorney, Agent, or Firm*—Pollock, VandeSande and Priddy

[57] ABSTRACT

Apparatus for folding collapsible box blanks transversely to a feed direction in which blanks are fed to strip-like tools each pivoted about an axis above a conveyor on which the blanks are supported, and transverse to the feed direction and having a sliding surface forming a ramp which rises from the conveyor in the feed direction downstream of the said axis. Unlike known apparatus, a movable depressor is provided to hold down the blank in the vicinity of the tools and further the folding tools are not driven. In the embodiments described they are restrained by a spring loaded locking device, against free pivotal movement until the torque applied to the tool during feeding of the blank, exceeds a predetermined minimum. In one embodiment, the folding tools are movable in the same direction as the conveyor but at a higher velocity, the resultant relative velocity determining the feed direction.

2 Claims, 7 Drawing Figures

APPARATUS FOR FOLDING COLLAPSIBLE BOX BLANKS

The invention relates to an apparatus for folding collapsible box blanks transversely of a feed direction. Usually, such apparatus has a conveyor for the blanks, pivotally mounted folding tools having sliding surfaces forming, in a basic position of the tools, ramps which rise from the conveyor in the feed direction. The axis about which the folding tools pivot lies upstream of the point at which the collapsible box blanks meet the ramps.

British Pat. No. 801,097 (corresponding to U.S. Pat. No. 2,857,827) describes apparatus in which the folding tools are driven by an oval wheel transmission the dimensions of which are such that the folding tools pivot at a speed which varies during the pivoting cycle. The important features of this apparatus are the forced guidance of the folding tools and the precisely predetermined pattern of movement.

Such known apparatus is not suitable for carrying out all the transverse folding operations required for collapsible box blanks (the term transverse folding operations includes folds with a crease line located at right-angles to the direction of conveyance of the collapsible box blanks). Particularly critical are transverse folds with a relatively narrow base area and relatively large collapsible boxes, such as are required, for example, in the case of cartons for cigarette packets. Such blanks have only a very small base area and requires special measures.

An object of the invention is to provide folding apparatus of simple construction and which can be competitively produced but which nevertheless is capable of performing transverse folding operations which are likely to be required for collapsible box blanks.

In accordance with this invention I propose apparatus which comprise a depressor for holding down a blank on the conveyor and movable into the vicinity of the tool.

In a particularly expedient embodiment, the gap between the depressor and the conveyor belts remains fixed at all times during the entire cycle of movement thereby to obviate the normally complicated system of kinematics used, in conventional machines where such depressors are lifted off the blank during the movement.

In contrast to such conventional solutions, it is sufficient to provide a relatively simple coupling transmission which links the feed movement of the conveyor to the reciprocating movement of the depressor. An expensive gear transmission which is provided in the case of the known depressors and which must in addition control the simultaneous variation of height (German Pat. No. 1,125,753), is avoided.

Furthermore, folding apparatuses are known in which transverse folds are made by means of so-called frontal or overlap hooks. The frontal hooks are mounted above the conveyor belts and have obliquely rearwardly and downwardly directed hook zones which, during forwards feeding of the carton blanks, become hooked into an upper portion of the flaps which are to be folded over. During feeding, the hooks hold the flaps fast while the adjacent portion of the bottom continues to move. This results in the portion which is to be folded over being moved aside and released again after the frontal hooks have passed through. Such a solution is provided for transverse folds which are upstream, with regard to the feed direction. In this known arrangement, the overlap hook runs more rapidly than the conveyor during the folding.

No folding apparatus is known, however, which is capable of folding over non-rigid flaps or sides. For example, the aforementioned known apparatus cannot fold long bottom flaps with cut-outs or with additional crease lines.

Therefore, the present invention is based on the problem of providing a folding apparatus of the general type mentioned in reference to British Pat. No. 801,097 at the outset which is, however, of particularly simple construction and which can be easily manufactured and which, by reason of its simplicity, is not susceptible to breakdown and which can reliably carry out any desired transverse folds even on complicatedly formed collapsible box blanks.

Using apparatus according to the present invention, it is readily possible to fold the flaps of collapsible box blanks which have additional crease lines or cut-outs. The provision of a depressor guarantees a reliable and positive guiding of the collapsible box blanks during the folding cycle. Both blanks with very short side parts and also those which have very long parts to be folded over can be folded and at high working speeds. The transverse folding station can be of short construction, since all the folds are, in contrast to known apparatus, carried out over the entire width of the collapsible box blank and at one single folding point.

Unlike conventional folding tools, no driving mechanism is provided to effect a turning movement of the folding tool, i.e., the tools of the apparatus according to this invention are not driven and, preferably, are restrained against pivotal movement from their basic position until the torque applied to the tool by the blank which is to be folded, during feeding of the said blank, exceeds a predetermined minimum. Since no driving mechanism is used for the folding tools, no driven shaft of the type shown in U.S. Pat. No. 2,857,827, or any shaft extending over the entire width of the machine, need be used and, instead, each folding tool can be mounted for pivotal motion on its own, very short shaft. The several pivot shafts need not be connected to one another and can be freely spaced from one another, whereby the machine of the present invention is not only simpler and less expensive than the prior art, but is adapted to solve folding problems which cannot be solved by the prior art.

It has been found expedient that the folding tools be of elongated strip form and have sliding surfaces on their front and rear edges. The provision of such folding tools in strip form, with two sliding surfaces means that the working speed can be relatively high. After each folding process, the pivotably mounted folding tools are rotated through 180°, moving them into their basic position. In the case of one such solution, the folding tools are rotated in only one direction. There is no time-consuming retrorotation.

The folding tools have locking means to secure them in their basic position. The locking means have spring-loaded stop members. These stop members act as ratchet devices and their spring force can be overcome by the force of a blank which engages the folding tools for pivoting of the folding tools. The ratchet force may possibly be adjusted and is thus adaptable to the thickness of the blanks which are to be folded.

Preferably, the depressor has a loosely mounted wheel or roller which is constructed to rest on the collapsible box blank. In this embodiment the depressor is capable of applying pressure to the passing blank, in any position.

In a preferred embodiment the conveyor comprises conveyor belts arranged side by side in spaced relation to each other. Preferably the spacing between the belt is fixed.

In contrast to the conventional apparatuses, it is not necessary, with the apparatus according to the invention, to alter the distance between the conveyor belts depending upon the dimensions of the blanks to be processed. The collapsible box blank is held on a very large supporting surface.

A preferred embodiment of the invention will now be described by way of example with reference to the accompanying diagrammatic drawings in which.

Figure 1:
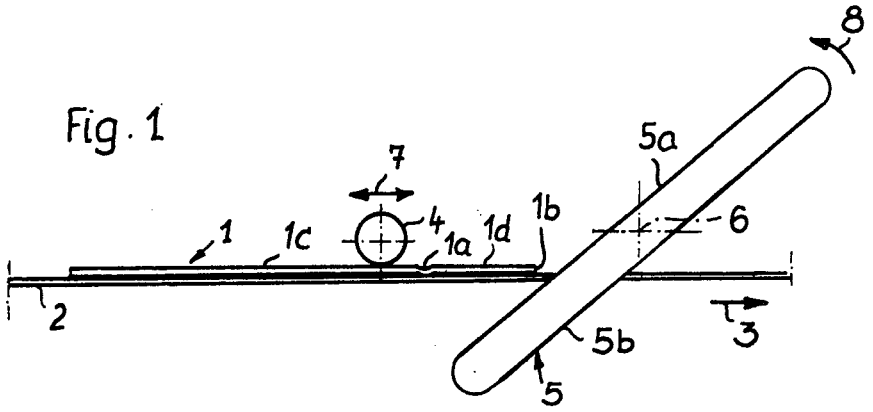
FIG. 1 is a side view of the folding apparatus in a position prior to commencement of the folding process.
Figure 2:
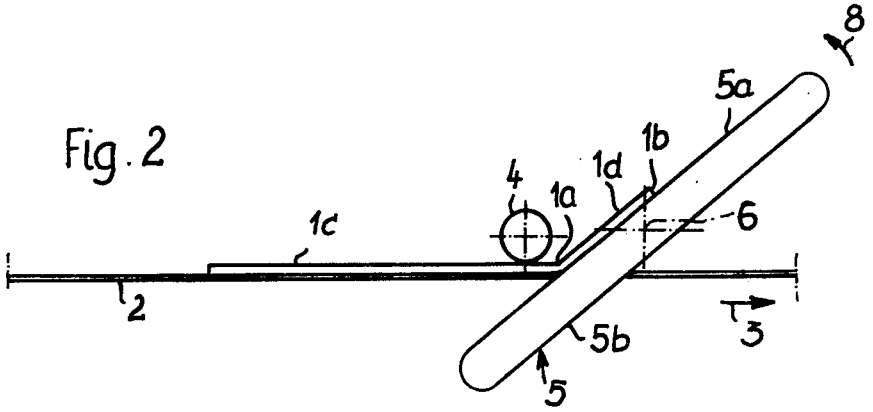
FIG. 2 is a side view of the folding apparatus shown in FIG. 1, during the folding process.
Figure 3:
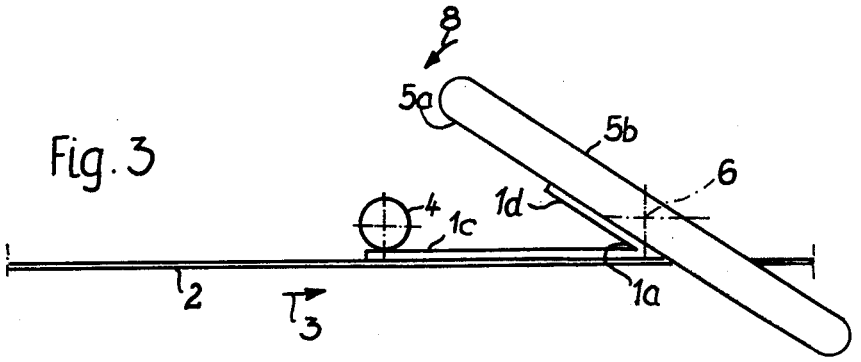
FIG. 3 is a side view of the folding apparatus immediately prior to completion of the folding process.

FIGS. 1 to 3 show conveyor belts 2 which move in the direction of the arrow 3, transporting the collapsible box blank 1 with the pre-stamped crease line 1*a* rightwards. The conveyor belts 2 are distributed at regular distances over the entire working width of the apparatus. In this respect, the gaps between the conveyor belts are such that there is space only for the pivotally mounted folding tools 5 between the conveyor belts. The drawings only show one folding tool 5 but in practice, any desired number of folding tools may be disposed one beside another. The axes 6 about which the folding tools 5 pivot are all aligned with one another.

Provided above the conveyor belt 2 and the collapsible box blank 1 is a depressor 4 which extends over the entire working width of the folding apparatus. The depressor 4 is a roller which is rotatably mounted at its ends and which, in the immediate vicinity of the fold line 1*a* presses the collapsible box blank 1 against the conveyor belts 2. The depressor 4 moves laterally in the direction of the double-headed arrow 7 either in or in opposition to the direction of conveyance of the conveyor belts 2. The depressor 4 is driven by known coupling transmissions (e.g., an actuating mechanism of the type disclosed in FIGS. 4–6, to be discussed) which permit of a reciprocating movement. The pattern of movement is such that the depressor 4 moves out of the position shown in FIG. 1 at the feed rate of the blank 1 and into the immediate vicinity of the folding tool 5 (see FIG. 2), stops there briefly, and then moves back into the starting position.

The depressor 4 may also be of a form other than the roller form illustrated. It may for example be a rigid straightedge or it may have individual fingers distributed over the width of the blank. The depressor 4 has only to ensure that, during the folding process, the blank 1 is held just behind the crease line 1*a* and is supported.

The folding tools 5 take the form of strips and have sliding faces on the front edge 5*a* and on the back edge 5*b* of each tool. A ratchet arrangement (to be described in reference to FIG. 7) draws the folding tools 5 into and holds them in the basic position shown in FIG. 1. The ratchet arrangement is so constructed that, after each folding operation, the folding tools are in each case rotated abut their axes 6 through 180° and are in their starting position as shown in FIG. 1. This means that the two faces 5*a* and 5*b* of each tool 5 alternatively act as the sliding surface.

The number of folding tools 5 used depends on the number and size of the blank parts which are to be folded over. In each case those folding tools 5 are actuated which lie between the conveyor belts 2 which carry the carton blank 1. It is possible to provide one folding tool between every two conveyor belts.

The folding apparatus works as follows:

The leading edge 1*b* of the collapsible box blank 1 is fed in the direction of the arrow 3 and strikes the sliding surface 5*a* of the folding tool 5. Since the depressor 4 is holding the rear portion 1*c* of the collapsible box blank 1 down onto the conveyor belts 2, the portion of the blank slides along the surface 5*a* of tool 5 into the position shown in FIG. 2. Upon an onwards feeding of the collapsible box blank 1 by the conveyor belts 2, the blank itself actuates folding tools 5 causing them to be pivoted about axes 6 in the direction of arrows 8, in fact into the position shown in FIG. 3. At the same time, this rotary movement of folding tool 5 completes the folding of the onwardly moving blank 1. After the blank 1 has passed under the folding tools 5, the folding tools are rotated into the basic position shown in FIG. 1 by the ratchet mechanism shown in FIG. 7 or by corresponding ratchet springs.

Figure 4:
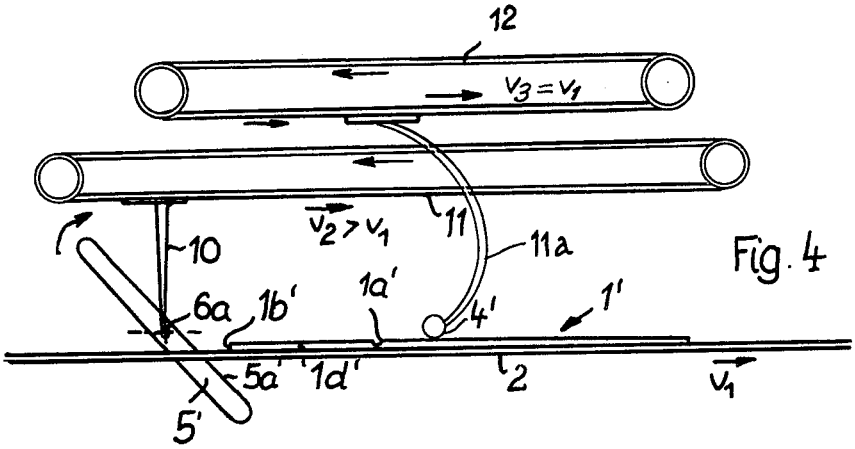
FIG. 4 is a side view of the folding apparatus for rearward flaps, in a position prior to commencement of the folding process.
Figure 5:
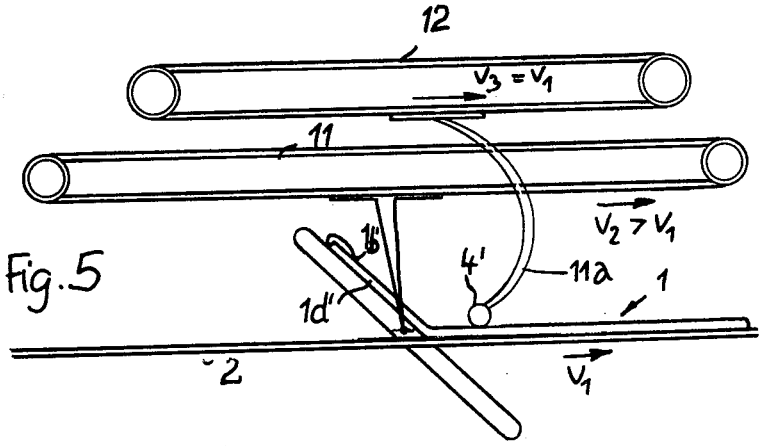
FIG. 5 is a side view of the folding apparatus shown in FIG. 4, during the folding process.
Figure 6:
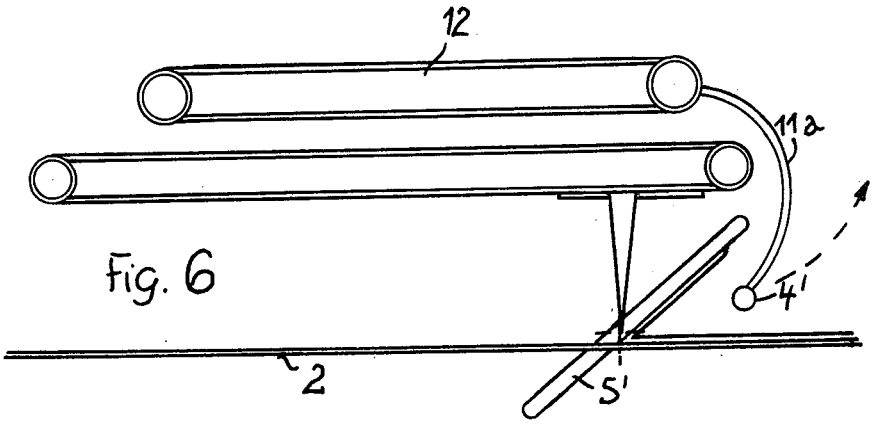
FIG. 6 is a side view of the folding apparatus according to FIGS. 4 and 5 immediately after completion of the folding process.

The apparatus for folding flaps located at the upstream (with regard to the feed direction) end of collapsible box blanks is shown in FIGS. 4 to 6. As in the case of the embodiment shown in FIGS. 1 to 3, the folding tools 5′ are mounted to rotate about an axis 6*a* disposed on a holder 10. The holder 10 is disposed on a revolving endless chain 11, the lower portion of which runs in the same direction as the conveyor belt 2. The collapsible box blank 1′ moves at the speed $v_1$ of the conveyor belt 2 according to FIG. 4, from left to right. Above the conveyor belt 2, the chain 11 moves at a speed $v_2$ which must in any case be higher than the speed $v_1$. In consequence, the sliding face 5*a*′ of the folding tool is first applied against the edge 1*b*′ of the box blank and pushes the flap 1*d* of the blank out of the position shown in FIG. 4 into the position shown in FIG. 5. Upon further movement of the folding tool 5′, the tool assumes the position shown in FIG. 6. Upon further movement of the depressor 4′ rightwards, this first reaches a position parallel with the conveyor belt 2 and finally pivots into a position which is rotated through 180° in respect of the starting position shown in FIG. 4.

The depressor 4′ is mounted on a rod 11*a* which is in turn mounted on a revolving chain 12. The lower portion of the chain runs in the direction of the conveyor belt 2 while its upper zone moves in the opposite direction. The speed of movement of the chain preferably corresponds to the speed of the conveyor belt 2.

Figure 7:
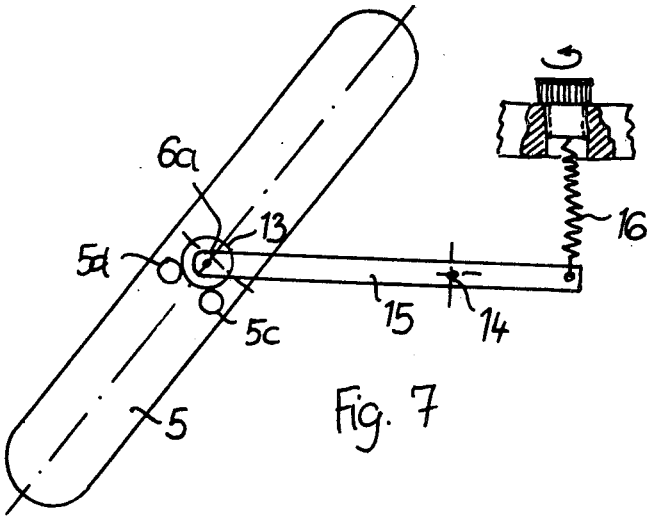
FIG. 7 is a diagrammatic view of the ratchet mechanism for the folding tool.

FIG. 7 diagrammatically shows the ratchet mechanism for the folding tools. The folding tool 5 is mounted on the axis 6*a* of the holder 10. The tool 5 has two laterally terminating round journals 5*c* and 5*d* against which rests a wheel 13. The wheel 13 is in turn mounted to pivot about a spindle 14 on a lever 15 which is at its rearward end loaded by an adjustable drawspring 16. When the drawspring 16 is extended, the pressure at which the wheel 13 is applied against the journals 5*c* and 5*d* is increased.

What is claimed is:

1. Apparatus for folding collapsible planar box blanks about fold lines disposed transversely to a feed direction of said blanks, comprising a conveyor for transporting the blanks in said feed direction, at least one elongated folding tool disposed adjacent said conveyor and extending in a direction transverse to said feed direction, said folding tool being mounted to pivot transversely to the conveyor about an axis located above the conveyor, means for moving the conveyor and the folding tool relative to one another to transport a blank toward the folding tool in the said feed direction to cause an edge of said blank to engage and exert a force on said folding tool at a position on said tool between said conveyor and said pivot axis, the force exerted by said blank on said tool being operative to pivot said tool about said axis without the need for a separate driving mechanism to effect such pivoting of the tool, means for restraining the folding tool against pivotal movement until the force applied to the tool by the blank to be folded during feeding of said blank exceeds a predetermined minimum whereby said force causes said folding tool to pivot, the folding tool having a sliding surface facing said edge of said blank and formed as a ramp which rises from the conveyor, said edge of said blank being adapted to slide along said ramp during said folding operation, a depressor positioned adjacent said conveyor for holding down a blank on the conveyor, and means for moving said depressor in a direction substantially parallel to the direction of motion of the conveyor toward and away from the folding tool during said folding operation.

2. Apparatus according to claim 1 wherein said means for restraining the tool comprises a locking device having a spring loaded stop member.

* * * * *